US005804270A

United States Patent [19]

Kawamura et al.

[11] Patent Number: 5,804,270

[45] **Date of Patent: *Sep. 8, 1998**

[54] COLLAPSIBLE TUBE AND ITS HEAD

[75] Inventors: Syukiti Kawamura, Osaka; Sumio Itamura, Kurashiki; Kazuyori Yoshimi, Osaka, all of Japan

[73] Assignee: Kuraray Co., Ltd., Kurashiki, Japan

[ * ] Notice: The terminal 17 months of this patent has been disclaimed.

[21] Appl. No.: 336,475

[22] Filed: Nov. 9, 1994

Related U.S. Application Data

[63] Continuation of Ser. No. 109,313, Aug. 19, 1993, abandoned.

[30] Foreign Application Priority Data

Aug. 26, 1992 [JP] Japan ..... 4-252290

[51] Int. Cl.[6] ..... B29D 23/00

[52] U.S. Cl. ..... 428/36.92; 428/35.4; 428/35.5; 428/36.7; 222/92; 206/277; 206/524.6; 525/57

[58] Field of Search ..... 428/35.4, 35.5, 428/35.6, 36.7, 36.92; 222/92; 206/277, 524.6; 525/57

[56] References Cited

U.S. PATENT DOCUMENTS

| | | | |
|---|---|---|---|
| 3,857,754 | 12/1974 | Hirata et al. | 161/227 |
| 3,931,449 | 1/1976 | Hirata et al. | 428/474 |
| 4,257,536 | 3/1981 | Hilmar . | |
| 5,082,743 | 1/1992 | Itamura et al. | 428/520 |
| 5,094,921 | 3/1992 | Itamura et al. | 428/520 |

FOREIGN PATENT DOCUMENTS

| | | | |
|---|---|---|---|
| A-3526286 | 2/1987 | Germany | B65D 30/08 |
| A-3930528 | 3/1991 | Germany | B29D 23/22 |
| 49-115346 | 2/1948 | Japan . | |
| 53-39380 | 11/1978 | Japan . | |
| 57-57338 | 12/1982 | Japan . | |
| 4-114869 | 4/1992 | Japan . | |
| 2117736 | 10/1983 | United Kingdom | B65D 5/60 |
| 2141723 | 1/1985 | United Kingdom | C08L 67/02 |
| WO 9106488 | 5/1991 | WIPO | B65D 75/62 |

*Primary Examiner*—Charles Nold
*Attorney, Agent, or Firm*—Cummings & Lockwood

[57] ABSTRACT

A collapsible tube is obtained by heat bonding a head to a polyolefin sleeve, the head comprising a composition which comprises a polyolefin resin (A), a saponified product of ethylene-vinyl acetate copolymer (B) having a melting point of at least 135° C., and a saponified product ethylene-vinyl acetate. copolymer (C) having a melting point of not more than 130° C.

5 Claims, 1 Drawing Sheet

COLLAPSIBLE TUBE AND ITS HEAD

This application is a continuation of application Ser. No. 08/109,313, filed Aug. 19, 1993, now abandoned.

BACKGROUND OF THE INVENTION

1. Field of the Invention

The present invention relates to a collapsible tube to be filled with contents such as foods, cosmetics or pharmaceuticals.

2. Description of the Prior Art

Well known is a process for producing what is known as a 2-piece collapsible tube (hereinafter sometimes simply referred to as "tube"). Thus, for example Japanese Utility Model Registration Application Laid-open No.115,346/1974 discloses the process which comprises forming a laminated film containing a barrier layer such as aluminum foil for protecting the contents into a cylindrical body or "sleeve" by sealing together both sides thereof or co-extruding thermoplastic resins including a barrier material through an annular die into a sleeve, and then heat bonding a head piece comprising a polyolefin resin to the sleeve.

Also known is a process for producing what is known as 1-piece collapsible tube. For example, Japanese Patent Publication No. 57,338/1982 discloses the process which comprises co-extruding thermoplastic resins including a barrier material into parisons and then blow molding the parisons each in a mold into tubes.

The above 2-piece tubes, however, have insufficient barrier properties for gases such as oxygen and flavor of the contents because the tube head comprises a polyolefin resin having little barrier properties.

It has been attempted, to improve the barrier properties of the head, to use a thermoplastic resin having excellent barrier properties. However, since a polyolefin resin is generally used for the body part of tubes from the viewpoint of moisture-proofness and heat sealability, it cannot be heat bonded to the above thermoplastic resin having barrier properties or is bonded, if at all, with very poor bond strength. The resulting tubes therefore have poor compressive strength and cannot be put into practical use.

Also proposed to improve the barrier properties of the tube head is a method which comprises patching a barrier materials such as aluminum foil on the inner surface of the head. However, this method makes complex the manufacturing process, thereby increasing production cost and, further, has the problem of possible deterioration of the aluminum foil depending on the nature of the contents.

The 1-piece tube as described above has many disadvantages caused by blow molding using a parison as follows. Tubes produced by this process tend to have weld lines due to the use of a split mold, and low accuracy in the screw portion of the neck part. Furthermore, tubes with its body having a large diameter as compared with that of the head are difficult to produce. The head part produced by this process has low rigidity and hence it tends to deform when a cap is screwed on or off. Besides, the head is insufficient in close fittability with the cap used so that the contents tend to leak.

To overcome these disadvantages and provide the head with good barrier properties, the present inventors attempted to incorporate a saponified product of ethylene-vinyl acetate copolymer (hereinafter referred to "B") having barrier properties into the polyolefin resin (hereinafter referred to as "A") constituting the head. However, although various incorporation ratios were tested, a tube having good commercial value could not be obtained because of insufficient barrier properties, poor strength of the head, in particular the screw part, and insufficient heat bondability to the polyolefin constituting the body.

The present inventors also tried incorporation of a polyolefin modified with a carboxylic acid or carboxylic acid anhydride into the aforementioned composition comprising (A) and (B). However, such a three-component composition showed a marked viscosity increase during melt molding, whereby defective moldings and short shots occurred due to an increase in melt viscosity. Further a lot of heat deteriorated substances generated at the die lip, and the molded products had poor appearance and could not be used in practice.

SUMMARY OF THE INVENTION

Accordingly, it is an object of the present invention to provide a 2-piece collapsible tube with improvements in the following items.

1) Barrier properties of the head

2) Heat bondability of the head to the body and compressive strength of the heat bonded part 3) Strength of the head 4) Rigidity of the head 5) Melt moldability of the head 6) Appearance of the head The present invention provides a collapsible tube comprising a head and a cylindrical body comprising a first polyolefin resin, said head and said cylindrical body being heat bonded to each other, said head comprising a composition which comprises a second polyolefin resin (A), a saponified product of ethylene-vinyl acetate copolymer (B) having a melting point of at least 135° C. and a saponified product of ethylene-vinyl acetate copolymer (C) having a melting point of not more than 130° C.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE PREFERRED EMBODIMENTS

Figure 1:
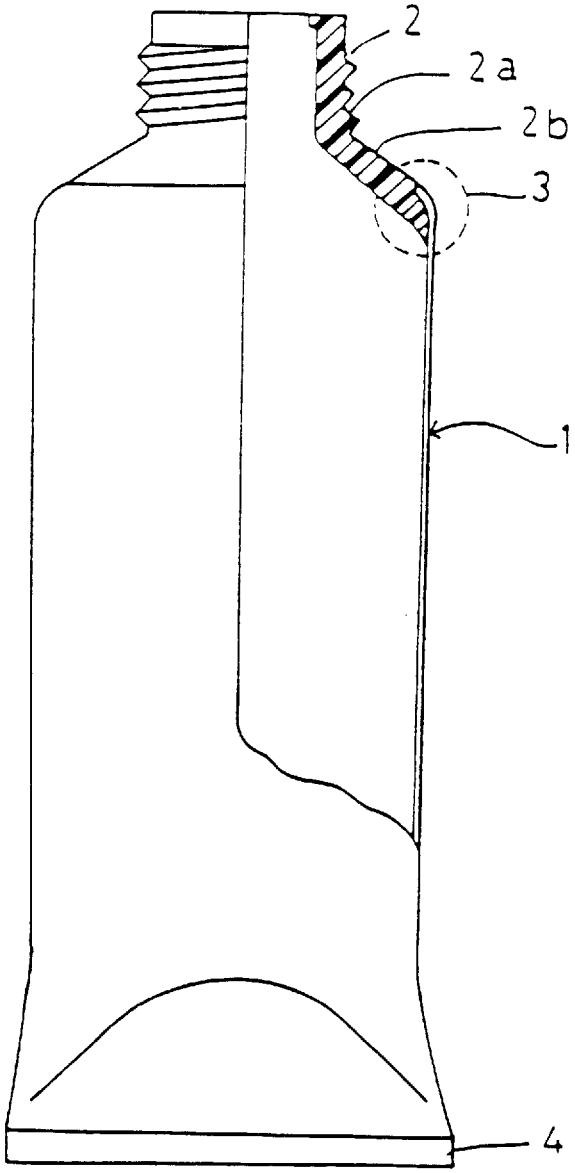
FIG. 1 is a schematic side view partly in section of an embodiment of the tube of the present invention and FIG. 2 is an enlarged cross-sectional view of the wall of the body of the tube of FIG. 1.

As described above, it is important that the composition for forming tube heads in the present invention comprise both (B) and (C) and that the melting point of (B) be at least 135° C., preferably 135° to 195° C., more preferably 140° to 170° C. and that of (C) be not more than 130° C., preferably 85° to 125° C., for the purpose of improving the barrier properties, heat bondability to tube body, strength and rigidity of the head.

If the melting point of (B) is less than 135° C. or that of (C) exceeds 130° C., the resulting head will have poor barrier properties, heat bondability to the body, strength and rigidity.

If the melting point of (B) exceeds 195° C. or that of (C) is less than 85° C., the melt moldability and heat bondability to the body will sometimes be insufficient.

In the present invention, it is desirable that the degree of saponification of (B) be at least 95%, preferably at least 97% and more preferably at least 99% and that of (C) be at least 20%, preferably at least 50% and more preferably in a range of 65 to 99%.

Further it is desirable that the degree of saponification of (B) be higher than that of (C), in particular higher by at least 1%, preferably by at least 2%.

If the degree of saponification of (B) or that of (C) is out of the aforementioned range, or that of (B) is lower than that of (C), the resulting head will sometimes become insufficient in barrier properties, strength and rigidity, or there will sometimes occur during melt molding of the head troubles such as decrease in melting point, generation of fish eyes and discoloration.

In the present invention, it is desirable that the melt flow rate (hereinafter referred to as "MFR") of the saponified products (B) and (C) be both in the range of 0.5 to 50 g/10 min and, in particular, that of (B) be in the range of 3.0 to 40 g/10 min and that of (C) in the range of 2.0 to 20 g/10 min, to improve the barrier properties, melt moldability and appearance of the head.

Within limits so as not to impair the purpose, function and effect of the present invention, the saponified products (B) and (C) may be copolymerized with other monomers.

Examples of the second polyolefin resin (A) used in the present invention include homopolymers and copolymers of olefins, such as polyethylene resins, e.g. low density polyethylene, medium density polyethylene, high density polyethylene, linear low density polyethylene, ultra low density polyethylene, ethylene-vinyl acetate copolymer, ethylene-propylene copolymer, copolymers of ethylene with (meth)acrylic acid or its esters and ionomers; polypropylene resins; polybutene resins and polypentene resins. These polyolefin resins may be used singly or as a mixture of two or more.

Among the polyolefin resins usable for constituting the tube head of the present invention, polyethylene resins are preferable in view of heat bondability to the tube body, strength and rigidity, melt moldability and moisture-proofness. Among the polyethylene resins, particularly preferred are medium to high density polyethylenes having a density as determined according to JIS K7112 of at least 0.930 g/cm$^3$.

The polyolefin resin constituting the head of the present invention preferably has a melt flow rate (MFR) of 0.5 to 30 g/10 min, more preferably 2.0 to 20 g/10 min and most preferably 3.0 to 15 g/10 min, because of the advantages in barrier properties, melt moldability, heat bondability to the body and appearance.

Likewise, it is desirable in the present invention to formulate the components of the composition constituting the head in such a ratio that the resulting melt flow rate (MFR) falls in the range of 0.5 to 30 g/10 min, in particular 2 to 20 g/10 min, in view of melt moldability, heat bondability to the body and appearance of the head.

The melt flow rate (MFR) referred to in the present invention is determined according to the method of JIS K6760 and at 210° C. under a load of 2160 g.

The composition constituting the head in the present invention may incorporate additives that are generally used for synthetic resin compositions, such as colorants, fillers, sunproofing agents, heat stabilizers, ultraviolet absorbers and plasticizers, singly or in combination depending on the intended purpose.

Further the composition may incorporate synthetic resins other than (A), (B) and (C) within limits so as not to impair the purpose, function and effect of the present invention.

In the present invention, compositions comprising a matrix phase of a polyolefin resin (A) and a disperse phase of a saponified product of ethylene-vinyl acetate copolymer (B) are most suitable for constituting the tube head, in view of melt moldability, strength, rigidity, appearance and heat bondability to the body, of the head.

The reason for the above is not quite clear, but it is considered to be, at least partly, as follows.

With respect to improvement in melt moldability, particles of the saponified product of ethylene-vinyl acetate copolymer (B), having a lower thermal stability compared with the polyolefin resin (A) are encapsulated in the matrix of the polyolefin resin (A), so that the particles are protected from heat deterioration due to oxygen during melt molding. With respect to improvement in strength and rigidity,. dispersion of the above saponified product (B), having high elasticity and rigidity, in a matrix of the polyolefin resin (A) permits the saponified product (B) to act as a filler having a high elasticity and rigidity.

As a result, the tube head in the present invention molded from such a dispersion is not destroyed when placed under external forces during the molding or by repeated screwing on-off of a cap, because of the improvement in strength characteristics and, further, does not deform when subjected to external forces by repeated screwing on-off of the cap because of the improvement in rigidity.

Improvement in heat bondability to the tube body is attributable to the fact that the matrix phase is a polyolefin resin (A) with a dispersant of the saponified product (B), the polyolefin resin (A) showing, naturally, high heat bondability to the polyolefin resin constituting the tube body. On the contrary, if the saponified product (B) constitutes a matrix phase with a dispersant of the polyolefin resin (A), the heat bondability will be far inferior to the above.

Furthermore, addition of a saponified product of ethylene-vinyl acetate copolymer (C) having a melting point of not more than 130° C. to the saponified product (B) greatly improves the dispersibility of the latter in the polyolefin resin (A), so that the barrier properties, heat bondability to the polyolefin resin constituting tube body, strength and rigidity of the head are improved to large extents. This effect is really surprising.

To prepare a structure made of a composition comprising a matrix phase of a polyolefin resin (A) and a disperse phase of a saponified product of ethylene-vinyl acetate copolymer (B), it is important to properly select the polymer properties of the polyolefin resin (A), the melting points, degrees of saponification and melt flow rates of the saponified products (B) and (C), and the formulation of resins (A) (B) and (C). The preparation can be readily made by the following procedure.

(1) To select a proper polyolefin resin (A) from the viewpoints of melt moldability, heat bondability to tube body, moisture proofness, strength and rigidity, (2) To select saponified products (B) and (C) each having a specific melting point, degree of saponification and MFR that fall in the ranges described above, and (3) To make trials while changing the formulation of resins (A), (B) and (C)

In the present invention, it is desirable that the composition constituting the head have an oxygen transmission rate (at 20° C., 85% RH) of not more than $5\times10^{-11}$ cc·cm/

$cm^2 \cdot sec \cdot cmHg$, preferably not more than $1 \times 10^{-11}$ $cc \cdot cm/cm^2 \cdot sec \cdot cmHg$ from the viewpoint of barrier properties, such as prevention of the contents in the tube from oxidation deterioration and from losing flavor.

The barrier properties vary depending on the types, dispersion state, formulation and the like of the olefin resin (A) and the saponified products (B) and (C). The desired barrier properties can, however, be obtained, as described above, by at first properly selecting the resin (A), (B) and (C), and then making trials while changing the formulation to find a proper one.

In particular, the state of dispersion influences the barrier properties. However, as described above, an excellent dispersion of a disperse phase of a saponified product (B) in a matrix of a polyolefin resin (A) can be obtained by at first selecting proper types of the resins (A), (B) and (C) from the viewpoints of melting point, melt flow rate and degree of saponification, and then finding out a proper formulation of the resins. Then, the excellent dispersion thus obtained can surely exert good barrier properties.

The state of dispersion can be observed on the cross-sections of the molded product in the direction of extrusion or injection and in a direction perpendicular to that of extrusion or injection, under a microscope, either directly or after coloring the saponified product (B) using iodine. The most preferable state of dispersion in the present invention is one where the particles of the saponified product (B) are finely dispersed and oriented in essentially 2-dimensional layers in the direction of extrusion or injection in the matrix phase of polyolefin resin (A).

If the saponified product (B) is not dispersed in 2-dimensional layers but dispersed in essentially one-dimensional lines, like longitudinally extending filaments, the barrier properties and strength are inferior to those with the dispersion being in essentially 2-dimensional layers.

To obtain the above good state of dispersion, the melt flow rates (MFR's) of the polyolefin resin (A) and saponified copolymer (B) used are very important. It is recommended that the MFR of the saponified product (B) be larger than that of the polyolefin resin (A), preferably by 5 g/10 min, more preferably by 10 g/10 min.

A composition constituting the tube head of the present invention that incorporates the components in a formulation satisfying the following conditions (1) and (2), preferably conditions (3) and (4) realizes a good state of dispersion with the matrix phase being the polyolefin resin (A) and the disperse phase the saponified product of ethylene-vinyl acetate copolymer (B), whereby the function and effect of the present invention are better exerted.

$$0.1 \leqq W(B)/W(T) \leqq 0.7 \quad (1)$$

$$0.1 \leqq W(C)/W(B) \leqq 5.0 \quad (2)$$

preferably, $$0.2 \leqq W(B)/W(T) \leqq 0.6 \quad (3)$$

$$0.2 \leqq W(C)/W(B) \leqq 3.0 \quad (4)$$

where,

W(T)=total weight of the composition,

W(B)=weight of (B) in the composition and

W(C)=weight of (C) in the composition

If the above ratio W(B)/W(T) is less than 0.1, the barrier properties, strength and rigidity of the tube head will tend to be insufficient. If the ratio exceeds 0.7, it will sometimes become impossible to make-the saponified product (B) a disperse phase and, rather, the saponified product (B) tends to form a matrix. In this case, the resultant head has very poor bondability to the body and poor melt moldability, thus failing to be of practical value.

If the ratio W(C)/W(B) is less than 0.1, the resulting tube head will tend to have poor barrier properties, strength and heat bondability to the body. If the ratio exceeds 5.0, the tube head will tend to have poor rigidity and melt moldability.

In the present invention, it is important that the tube body have an innermost layer of a polyolefin resin in view of heat bondability to the head, heat weldability of the bottom part, squeeze and moisture-proofness.

First polyolefin resins used for the tube body in the present invention can be selected from the above-described second polyolefin resins suitable for tube head. Examples of preferable polyolefin resins for tube body include polyethylene resins, in particular low density polyethylene, linear low density polyethylene and ultra low density polyethylene. These polyethylenes may be used singly or in combination. The first polyolefin resin may or may not be the same as the second polyolefin resin.

Among these polyolefins, those having a density of 0.945 $g/cm^3$ or less, preferably 0.940 $g/cm^3$ or less, more preferably 0.930 $g/cm^3$ or less are advantageous in view of heat bondability to tube head, heat weldability at the bottom, squeeze and anti-air-back property.

In the present invention, the layer construction of the body preferably comprises an inner layer of the afore-mentioned polyethylene resin film, an intermediate layer of a barrier material such as an aluminum foil, a saponified product of ethylene-vinyl acetate copolymer (i.e. ethylene-vinyl alcohol copolymer) film, a polyvinylidene chloride (PVDC) film or a PVDC-coated oriented polypropylene film (KOPP), oriented polyamide film (KON) or oriented polyethylene terephthalate film (KPET), and an outer layer of a polyolefin resin, preferably polyethylene resin.

To enhance the rigidity of the body, making the intermediate layer a composite layer with an oriented film is desirable. To prevent air back, making the intermediate layer a composite layer with a paper and/or an aluminum foil is preferable.

It is also desirable, when necessary, that the intermediate layer be in the form of a composite layer of two or more films. For example, formation of a composite of the afore-mentioned barrier film and paper is recommended to impart barrier properties, as well as to prevent air back. Also recommended is to make a composite of an oriented polyester film and an aluminum foil to increase rigidity, as well as to provide barrier properties.

Further it is recommended, for the purpose of providing anti-air-back property, moisture-proofness, barrier properties and transparency, to make a composite of a biaxially oriented high density polyethylene film having an excellent anti-air-back property, moisture-proofness and transparency with a saponified product of ethylene-vinyl acetate copolymer (i.e. ethylene-vinyl alcohol copolymer) film having excellent barrier properties and transparency.

Sleeves for tube bodies can be produced by (1) preparing a laminated film by dry lamination, shaping the laminated film into a sleeve by sealing the sides together; (2) when all the components constituting the body are thermoplastic resins, co-extruding the component resins into a multilayered film or sheet and then forming the film or sheet into a sleeve by sealing; or (3) directly co-extruding the component resins through an annular die into a sleeve.

Surface or back surface printing on sleeves is recommended for increasing commercial values.

The collapsible tube of the present invention can be produced using the afore-described resin composition for the head by any one of per se known processes of (1) injection molding, (2) disk process and (3) compression molding.

Each of these processes will now be described.

(1) Injection molding

A process for producing collapsible tubes which comprise injection molding the composition into a mold where a sleeve for forming the body and prepared beforehand has been inserted, to mold a head and, simultaneously therewith, heat bond the head to the sleeve.

(2) Disk process

A process for producing collapsible tubes which comprises extruding the composition through a T-die into a sheet, punching the sheet to obtain disks, placing each one of the disks in a female mold for molding head, supplying to the same mold a sleeve for forming the body and previously prepared and pressing the mold with a male mold under heating, thereby simultaneously forming the head and heat bonding the head to the sleeve.

(3) Compression molding

This process is disclosed in Japanese Patent Application Laid-open No. 25,411/1981 (Japanese Patent Publication No. 7850/1989). A process for producing collapsible tubes which comprises placing the composition having been plasticized in a female mold, supplying to the same mold a sleeve for forming the body and previously prepared and pressing the mold with a male mold under heating, thereby simultaneously forming the head and heat bonding the head to the sleeve.

EXAMPLES

Other features of the invention will become apparent in the course of the following descriptions of exemplary embodiments which are given for illustration of the invention and are not intended to be limiting thereof. In the Examples and Comparative Examples that follow, evaluations were made according to the following methods.

(1) Barrier properties (1-1) Oxygen transmission rate

A resin composition sample is melt extruded through a T-die at 235° C. into a film having a thickness of 100 $\mu$m. The film obtained is conditioned at 20° C., 85% RH for 3 weeks, and then subjected to test for oxygen transmission rate using an oxygen transmission tester (Ox-Tran 100, (manufactured by Modern Control Inc. in U.S.A.) according to JIS K7126 at 20° C., 85% RH.

(1-2) Filling test

A tube sample is filled with "miso" (bean paste) through the bottom opening until it overflows through the mouth and then the bottom is sealed by heat fusion.

After removal of the "miso" overflown through the mouth, a disc of aluminum foil having a thickness of 25 $\mu$m is applied to the mouth and the tube is then closed by screwing a cap.

A plurality of the tubes thus filled with "miso" are allowed to stand in a thermo-hygrostat at 40° C., 50% RH. They are taken out at intervals, one by one, and the head of each of them is broken with cutting pliers and the "miso" contacting the inside of the head is visually checked for the degree of discoloration if any.

(2) Heat bondability

The body of a tube sample is longitudinally cut at 2 points on the opposite sides up above a line of heat bonding to the head to obtain 2 test pieces having a width of 15 mm. The cut-out test pieces are conditioned at 20° C., 65% RH for one week, and then subjected to test for the peel strength of the bonded part. For the test, both ends of the specimen is mounted on the chuck of a tensile tester and the specimen is extended according to JIS K7127, at 20° C., 65% RH, and at an extension rate of 50 mm/min. It is necessary for practical purposes that the peel strength be at least 1 kg/15 mm, preferably at least 2.5 kg/15 mm and, for pressure-resistant tubes, at least 3.0 kg/15 mm.

(3) Strength

In a room conditioned at 20° C., 65% RH, a tube sample is subjected to repeated cycles of screwing and unscrewing of a cap for 30 times with a torque of 5 kg·cm. After the operation, the sample is checked visually and with the aid of a magnifier for cutouts and/or cracks on the screwthread part of the neck and cracks on the head.

(4) Rigidity

A tube sample is closed by screwing a cap by hand and the head is checked for the degree of deformation. Also, the head is deformed by pressing by hand and the state of the head is recorded.

(5) Appearance

The head of a tube sample is visually checked for the appearance (surface state, discoloration, gel and/or fish-eye generation and the like);

(6) Melt moldability

During molding of a composition, there are checked the state of generation of heat deteriorates developed on the die lip for extrusion molding or around the nozzle for injection molding. Also observed is the state of extrusion or injection molding (for example, short shots, that is, defective molding due to shortage of the amount discharged caused by insufficient throughput of resin).

The evaluations were made according to the criteria shown in Table 1. For practical purposes, at least the level α, preferably at least the level ○ is required.

TABLE 1

Melt Moldability

| Evaluation Result | Symbol |
|---|---|
| Excellent | ◎ |
| Good | ○ |
| Marginal | Δ |
| Poor (impossible to use) | X |

The state of dispersion on the cross section of the head of a tube sample is evaluated according to the criteria shown in Table 2.

TABLE 2

| Rating | State of dispersion | Evaluation |
|---|---|---|
| M-1: | In a matrix of polyolefin resin (A), the saponified product (B) is dispersed mainly in two-dimensional layers and partly in one-dimensional lines, like filaments. | Excellent |
| M-2: | In a matrix of polyolefin resin (A), the saponified product (B) is equally dispersed in two-dimensional layers and in one-dimensional lines. | Good |
| M-3: | In a matrix of polyolefin resin (A), the saponified product (B) is dispersed mainly in one-dimensional lines like filaments, and partly in two-dimensional layers. | Marginal |
| M-4: | In a matrix of the saponified product (B), polyolefin resin (A) is dispersed. | Poor |

Figure 2:
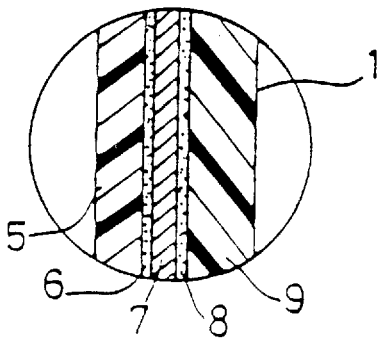

FIG. 1 is a schematic side view partly in section of a collapsible tube prepared in the following Examples and Comparative Examples and FIG. 2 is an enlarged view of the cross-section of the body wall of the tube shown in FIG. 1. In FIG. 1, a head 2 having male screw 2*a* on the upper part and shoulder 2*b* on the lower part is heat bonded 3 to the top edge of a cylindrical body 1. The bottom of the body 1 is heat sealed 4. In FIG. 2, the cylindrical body 1 is a laminate consisting of layers of, from inside, a polyolefin resin 5, an adhesive 6, a barrier material 7, an adhesive 8 and a thermoplastic resin 9.

The characteristics of the resins used in Examples and Comparative Examples are shown in Tables 3 through 5. The construction and production processes of the cylindrical bodies (sleeves) are shown in tube body are shown in Table 6.

Example 1

Fourty (40) parts by weight (hereinafter "parts" means "parts by weight") of high density polyethylene (A-1), 40 parts of a saponified product of ethylene-vinyl acetate copolymer (B-3) and 20 parts of a saponified product of ethylene-vinyl acetate (C-1) were dry blended and the blend was melt extruded and pelletized at 230° C. through a twin-screw extruder, to give pellets for molding tube heads.

The pellets thus obtained were fed to an injection molding machine for producing collapsible tubes, in the mold of which a previously prepared sleeve (D-1) for forming the body had been supplied, and injection molding was carried out to obtain tubes.

Here, the machine was a 35-mmϕ in-line screw type injection molding machine, and the molding was conducted at a cylinder temperature of 240° C. nd a nozzle temperature of 235° C. The tubes obtained had an outside diameter at the heat bonded part of 35 mm, an outside and inside diameter at the mouth of 12 mm and 7 mm respectively and a wall thickness at the shoulder of 2 mm.

The results of evaluation are shown in Table 7.

Examples 2 through 8 and Comparative Examples 1 through 10

Tubes were produced following the procedure of Example 1 and using the compositions and sleeves shown in Tables 7 through 10 where sleeves used were all (D-1) except that Example 8 used (D-2).

The results of evaluation are shown in Tables 7 through 10.

Example 9

Blended pellets for molding tube head were prepared by melt extrusion in the same manner as in Example 1, using the 40 parts of high density polyethylene (A-1), 40 parts of a saponified product of ethylene-vinyl acetate copolymer (B-3) and 20 parts of a saponified product of ethylene-vinyl acetate copolymer (C-1).

The pellets thus obtained were melted through a 60-mmϕ extruder at a temperature of 230° C. and extruded through a T-die at 210° C., to form a sheet. The sheet obtained was punched to give disks. Each of the disks thus obtained was placed in a female mold for molding head of a disk process tube molding machine. Also a previously prepared sleeve (D-2) for forming the body was placed in the mold. Then, with heating at 235° C. male mold was used to press the female mold, thereby molding the heat and, simultaneously therewith, heat bonding the head to the sleeve, to obtain a tube.

The tube thus prepared had an outside diameter at the heat bonded part of 35 mm, an outside and an inside diameters of the mouth of 12 mm and 7 mm respectively and a wall thickness at the shoulder of 2 mm.

The results of evaluation are shown in Table 8.

Examples 10 through 12 and Comparative Examples 11 through 12

Tubes Were produced following the same procedure as used in Example 9 using the compositions and sleeves described in Tables 8 and 10.

The results of evaluation are shown in Tables 8 and 10.

Comparative Example 13

A 3-type/5-layer blow molding machine was used to extrude through a die head at 220° C. to prepare parisons. Each of the parisons was blow molded in a split mold. The molded products were cut at the bottom, to give a one-piece blow molded collapsible tubes with its body having a thickness construction of high density polyethylene (A-1) 100 μm/high density polyethylene graft-modified with maleic anhydride (A-4) 50 μm/saponified product of ethylene-vinyl acetate copolymer (B-1) 30 μm/high density polyethylene graft-modified with maleic anhydride (A-4) 50 μm/high density polyethylene (A-1) 100 μm.

The results of evaluation are shown in Table 10.

TABLE 3

| Polyolefin Resin | | | | |
|---|---|---|---|---|
| Resin No. | Type (Supplier, trade name) | Melt-point (°C.) | MFR (210° C., 2160 g;) (g/10 min) | Density (g/cm$^3$) |
| A-1: | High density polyethylene (Showa Denko K. K.; HD-5050) | 128 | 7.6 | 0.950 |
| A-2: | Medium density polyethylene (Mitsui Petrochemical Industries, Ltd.; NEOZEX 4060J) | 124 | 11.9 | 0.944 |
| A-3: | Low density polyethylene (Tosoh Co., Ltd.; PETROCEN 340) | 110 | 9.8 | 0.923 |
| A-4: | High density polyethylene graft-modified with maleic anhydride (Mitsubishi Petrochemical Co., Ltd. MODIC H-400F) | 128 | 1.8 | 0.930 |
| A-5: | Low density polyethylene graft modified with maleic anhydride (Mitsui Petrochemical Industries, Ltd. ADMER NF-500) | 120 | 2.5 | 0.920 |
| A-6: | Ionomer (DuPont-Mitsui Polychemicals Co., Ltd.; HI-MILAN 1650) | 91 | 3.0 | 0.950 |
| A-7: | Ethylene-vinyl acetate copolymer (Tosoh Co., Ltd.; URTRASEN 630F) | 90 | 2.8 | 0.940 |

TABLE 4

| Saponified product of ethylene-vinyl acetate copolymer (B) | | | | |
|---|---|---|---|---|
| Resin No. | Melting point (°C.) | Ethylene content (mol %) | Degree of Saponification (%) | MFR (210° C., 2160 g; g/10 min) |
| B-1 | 191 | 27 | 99.5 | 3.7 |
| B-2 | 165 | 44 | 99.5 | 13.0 |
| B-3 | 160 | 47 | 99.5 | 33.0 |
| B-4 | 143 | 59 | 99.5 | 19.6 |

TABLE 5

| Saponified product of ethylene-vinyl acetate copolymer (C) | | | | |
|---|---|---|---|---|
| Resin No. | Melting point (°C.) | Ethylene content (mol %) | Degree of Saponification (%) | MFR (210° C., 2160 g; g/10 min) |
| C-1 | 109 | 89 | 96 | 11.7 |
| C-2 | 112 | 91 | 94 | 4.5 |

TABLE 6

| Manufacture and Structure of Tube | |
|---|---|
| Tube No. | Production process and construction of sleeve |
| D-1 | A 4-layer film having a construction of low density polyethylene film (density 0.920 g/cm$^3$) 150$\mu$ m/aluminum foil 20$\mu$ m/biaxially oriented polyethylene terephthalate film (Toray, LUMINAR) 12$\mu$ m/low density polyethylene film (density 0.923 g/cm$^3$) 15$\mu$ m was produced by dry lamination. The film laminate was formed into a sleeve with the low density polyethylene film with a density of 0.920 g/cm$^3$ facing inward, and the low density polyethylene film layer with a density of 0.920 g/cm$^3$ and that with a density of 0.923 g/cm$^3$ were heat bonded along the sides to form a sleeve having a diameter of 35 mm. |
| D-2 | A 5-layer sleeve having a construction (from inside) of linear low density polyethylene (density 0.920 g/cm$^3$) 140$\mu$ m/linear low density polyethylene graft-modified with maleic anhydride (A-5) 20$\mu$ m/saponified product of ethylene-vinyl acetate copolymer (B-1) 30$\mu$ m/linear low density polyethylene graft-modified with maleic anhydride (A-5) 20$\mu$ m/low density polyethylene (density 0.920 g/cm$^3$) 140$\mu$ m (to outside) and having a diameter of 35 mm was co-extruded through an annular die. |

TABLE 7

EXAMPLES (Part 1)

| Head resin composition & characteristics | | | | | | | | | |
|---|---|---|---|---|---|---|---|---|---|
| | Composition | | | | | Characteristics | | Sleeve | |
| Ex. No. | (A) weight parts | (B) weight parts | (C) weight parts | W (B)/W (T) | W (C)/W (B) | MFR | OTR* | structure (No.) | Molding process |
| 1 | A-1 40 | B-3 40 | C-1 20 | 0.4 | 0.5 | 15.0 | 0.305 | D-1 | Injection |
| 2 | A-1 40 | B-4 40 | C-1 20 | 0.4 | 0.5 | 12.5 | 0.609 | D-1 | Injection |
| 3 | A-1 40 | B-2:30 B-4:10 | C-1 20 | 0.4 | 0.5 | 11.0 | 0.450 | D-1 | Injection |
| 4 | A-1 40 | B-3 40 | C-2 20 | 0.4 | 0.5 | 13.0 | 0.411 | D-1 | Injection |
| 5 | A-1 40 | B-3 40 | C-2 20 | 0.4 | 0.5 | 17.8 | 0.561 | D-1 | Injection |
| 6 | A-1 60 | B-3 20 | C-1 20 | 0.2 | 1.0 | 11.1 | 12.2 | D-1 | Injection |

| Results of evaluation | | | | | | | | |
|---|---|---|---|---|---|---|---|---|
| | | | Heat bondability | | | | | |
| Ex. No. | State of dispersion | Filling test | Peeling strength kg/15 mm | Evaluation | St** of head | Rigidity of head | Appearance | Melt moldability |
| 1 | M-1 | ⊚ | 6.3 | ⊚ | ⊚ | ⊚ | ⊚ | ⊚ |
| 2 | M-1 | ⊚ | 6.0 | ⊚ | ⊚ | ⊚ | ⊚ | ⊚ |
| 3 | M-1 | ⊚ | 5.8 | ⊚ | ⊚ | ⊚ | ⊚ | ⊚ |
| 4 | M-1 | ⊚ | 6.1 | ⊚ | ⊚ | ⊚ | ⊚ | ⊚ |

TABLE 7-continued

EXAMPLES (Part 1)

| | | | | | | | | |
|---|---|---|---|---|---|---|---|---|
| 5 | M-1 | ◎ | 5.7 | ◎ | ◎ | ◎ | ◎ | ◎ |
| 6 | M-1 | ○ | 6.2 | ◎ | ◎ | ○ | ◎ | ◎ |

*Oxygen transmission rate $\{(cc \cdot cm)/(cm^2 \cdot sec \cdot cmHg)\} \times 10^{12}$
**Strength

TABLE 8

EXAMPLES (Part 2)

| | Head resin composition & characteristics | | | | | | | | |
|---|---|---|---|---|---|---|---|---|---|
| | Composition | | | | | Characteristics | | Sleeve | |
| Ex. No. | (A) weight parts | (B) weight parts | (C) weight parts | W (B)/W (T) | W (C)/W (B) | MFR | OTR* | structure (No.) | Molding process |
| 7 | A-1 50 | B-3 40 | C-1 10 | 0.4 | 0.25 | 14.2 | 3.07 | D-1 | Injection |
| 8 | A-1 40 | B-3 40 | C-1 20 | 0.4 | 0.5 | 15.0 | 0.305 | D-2 | Injection |
| 9 | A-1 40 | B-3 40 | C-1 20 | 0.4 | 0.5 | 15.0 | 0.305 | D-2 | Disc |
| 10 | A-3 50 | B-1 40 | C-2 10 | 0.4 | 0.25 | 6.2 | 10.62 | D-2 | Disc |
| 11 | A-3 50 | B-2 40 | C-2 10 | 0.4 | 0.25 | 10.5 | 5.32 | D-2 | Disc |
| 12 | A-3 40 | B-3 40 | C-1 20 | 0.4 | 0.5 | 17.0 | 1.31 | D-2 | Disc |

| | Results of evaluation | | | | | | | |
|---|---|---|---|---|---|---|---|---|
| | | | Heat bondability | | | | | |
| Ex. No. | State of dispersion | Filling test | Peeling strength kg/15 mm | Evaluation | St** of head | Rigidity of head | Appearance | Melt moldability |
| 7 | M-2 | ◎ | 4.3 | ○ | ○ | ◎ | ○ | ◎ |
| 8 | M-1 | ◎ | 6.2 | ◎ | ◎ | ◎ | ◎ | ◎ |
| 9 | M-1 | ◎ | 6.2 | ◎ | ◎ | ◎ | ◎ | ◎ |
| 10 | M-3 | ○ | 3.1 | ○ | ○ | ○ | ○ | ○ |
| 11 | M-2 | ◎ | 4.0 | ○ | ○ | ○ | ○ | ○ |
| 12 | M-1 | ◎ | 5.9 | ◎ | ◎ | ○ | ◎ | ◎ |

*Oxygen transmission rate $\{(cc \cdot cm)/(cm^2 \cdot sec \cdot cmHg)\} \times 10^{12}$
*Strength

TABLE 9

COMPARATIVE EXAMPLES (Part 1)

| | Head resin composition & characteristics | | | | | | | | |
|---|---|---|---|---|---|---|---|---|---|
| Comp. | Composition | | | | | Characteristics | | Sleeve | |
| Ex. No. | (A) weight parts | (B) weight parts | (C) weight parts | W (B)/W (T) | W (C)/W (B) | MFR | OTR* | structure (No.) | Molding process |
| 1 | A-1 100 | — | — | — | — | 7.6 | 122 | D-1 | Injection |
| 2 | — | B-3 100 | — | — | — | 33.0 | 0.101 | D-1 | Injection |
| 3 | A-1 60 | B-3 40 | — | 0.4 | — | 13.6 | 2) | D-1 | Injection |
| 4 | A-1 60 | — | C-1 40 | — | — | 9.2 | 198 | D-1 | Injection |
| 5 | A-1:40 A-2:20 | B-3 40 | — | 0.4 | — | 1.5 | 15.2 | D-1 | Injection |
| 6 | A-2:40 A-4:20 | B-1 40 | — | 0.4 | — | 1.2 | 18.1 | D-1 | Injection |

TABLE 9-continued

COMPARATIVE EXAMPLES (Part 1)

| Comp. Ex. No. | State of dispersion | Filling test | Results of evaluation: Heat bondability: Peeling strength kg/15 mm | Heat bondability: Evaluation | St** of head | Rigidity of head | Appearance | Melt moldability |
|---|---|---|---|---|---|---|---|---|
| 1 | — | X | 4.0 | ⊙ | ○ | Δ | ⊙ | ⊙ |
| 2 | — | — | — | X 1) | — | — | — | Δ |
| 3 | M-3 | X | 0.5 | X | X | Δ | X | ○ |
| 4 | — | X | 5.5 | ⊙ | X | X | Δ | ○ |
| 5 | M-3 | ○ | 2.1 | Δ | ○ | ○ | X | X 3) |
| 6 | M-3 | ○ | 2.2 | Δ | ○ | ○ | X | X 3) |

*Oxygen transmission rate $\{(cc \cdot cm)/(cm^2 \cdot sec \cdot cmHg)\} \times 10^{12}$

**Strength

Notes:

1) Poor heat bonding

2) Measurement impossible due to bad surface condition

3) Changed yellow, gels generated.

TABLE 10

COMPARATIVE EXAMPLES (Part 2)

| Comp. Ex. No. | Head resin composition & characteristics: Composition (A) weight parts | (B) | (C) | W (B)/W (T) | W (C)/W (B) | Characteristics MFR | OTR* | Sleeve structure (No.) | Molding process |
|---|---|---|---|---|---|---|---|---|---|
| 7 | A-4 60 | B-3 40 | — | 0.4 | — | 0.5 | 14.5 | D-1 | Injection |
| 8 | A-1:40 A-5:20 | B-3 40 | — | 0.4 | — | 0.9 | 16.2 | D-1 | Injection |
| 9 | A-1:40 A-6:20 | B-3 40 | — | 0.4 | — | 11.5 | 30.5 | D-1 | Injection |
| 10 | A-1:40 A-7:20 | B-3 40 | — | 0.4 | — | 11.0 | 32.5 | D-1 | Injection |
| 11 | A-3 100 | — | — | — | — | 9.8 | 305 | D-2 | Disk |
| 12 | — | B-3 40 | C-1 60 | 0.4 | 1.5 | — | 13.7 | D-2 | Disk |
| 13 | — | — | — | — | — | — | — | — | Blowing |

| Comp. Ex. No. | State of dispersion | Filling test | Results of evaluation: Heat bondability: Peeling strength kg/15 mm | Heat bondability: Evaluation | St** of head | Rigidity of head | Appearance | Melt moldability |
|---|---|---|---|---|---|---|---|---|
| 7 | M-3 | ○ | 3.0 | ○ | ○ | ○ | X | X 4) |
| 8 | M-3 | ○ | 2.5 | Δ | ○ | Δ | X | X 4) |
| 9 | M-3 | Δ | 1.8 | Δ | Δ | Δ | X | X 5) |
| 10 | M-3 | Δ | 0.6 | X | X | Δ | X | X 5) |
| 11 | — | X | 4.1 | ⊙ | ○ | X | ⊙ | ⊙ |

TABLE 10-continued

| COMPARATIVE EXAMPLES (Part 2) | | | | | | | | |
|---|---|---|---|---|---|---|---|---|
| 12 | M-3 | ○ | 2.5 | Δ | X | X | X | ○ |
| 13 | — | ◎ | — | — | X | X | Δ | ○ |

*Oxygen transmission rate $\{(cc \cdot cm)/(cm^2 \cdot sec \cdot cmHg)\} \times 10^{12}$
**Strength
Notes:
4) Changed yellow; gels generated.
5) Gels generated.

Next, the preferred embodiments of the present invention are described.

Embodiment 1

As described above, a tube head to be bonded to a sleeve to form a collapsible tube comprises a composition comprising an olefin resin (A), a saponified product of ethylene-vinyl acetate copolymer (B) having a melting point of at least 135° C. and a saponified product of ethylene-vinyl acetate copolymer (C) having a melting point of not more than 130° C., the composition having a matrix phase of the polyolefin resin (A) and a disperse phase of the saponified product of the ethylene-vinyl acetate copolymer (B).

Embodiment 2

The saponified product of ethylene-vinyl acetate copolymer (B) constituting the tube head has a degree of saponification of at least 95% and the saponified product of ethylene-vinyl acetate copolymer (C) has a degree of saponification of at least 20%.

Embodiments 3

The degree of saponification of the saponified product of ethylene-vinyl acetate copolymer (B) is higher than that of the saponified product of ethylene-vinyl acetate copolymer (C).

Embodiment 4

The composition constituting the tube head has an oxygen transmission rate under an atmosphere of 20° C., 85% RH of not more than $5\times10^{-11}$ cc·cm/cm$^2$·sec·cmHg.

Embodiment 5

The melt flow rate (MFR) of the saponified product of ethylene-vinyl acetate copolymer (B) is larger than that of the polyolefin resin (A).

Embodiment 6

The composition constituting the tube head satisfies the following conditions (1) and (2).

$$0.1 \leqq W(B)/W(T) \leqq 0.7 \quad (1)$$

$$0.1 \leqq W(C)/W(B) \leqq 5.0 \quad (2)$$

where,

W(T)=total weight of the composition

W(B)=weight of (B) in the composition

W(C)=weight of (C) in the composition

Embodiment 7

The tube body comprises a barrier material.

In the above embodiments, the head can be provided with improved barrier properties, heat bondability to the body, compressive strength of the bonded part, strength, rigidity, melt moldability and appearance.

Obviously, numerous modifications and variations of the present invention are possible in light of the above teachings. It is therefore to be understood that within the scope of the appended claims, the invention may be practiced otherwise than as specifically described herein.

What is claimed is:

1. A two-piece collapsible tube comprising (1) a head and (2) a cylindrical body, said cylindrical body consisting essentially of a multilayered structure comprising a layer of a first polyolefin resin and a layer of a barrier material, wherein said first polyolefin resin layer substantially effects joinder of said body to said head; and said head consisting essentially of a layer comprising a mixture of a second polyolefin (A), a saponified product of an ethylene-vinyl acetate copolymer (B) having a melting point of at least 135° C., and a saponified product of an ethylene-vinyl acetate copolymer (C) having a melting point of not more than 130° C.

2. A head to be bonded to a sleeve to constitute a two-piece collapsible tube, said head consisting essentially of a layer comprising a mixture of a polyolefin resin (A), a saponified product of ethylene-vinyl acetate copolymer (B) having a melting point of at least 135° C., and a saponified product of ethylene-vinyl acetate copolymer (C) having a melting point of not more than 130° C.

3. A collapsible tube as defined in claim 2 wherein the ethylene-vinyl acetate copolymer (B) has a degree of saponification of at least 95% and the ethylene-vinyl acetate copolymer (C) has a degree of saponification of at least 20%.

4. A collapsible tube as defined in claim 2 wherein the degree of saponification of the ethylene-vinyl acetate copolymer (B) is higher than that of the ethylene-vinyl acetate copolymer (C).

5. A collapsible tube as defined in claim 2 wherein the cylindrical body comprises a multilayered structure comprising an inner layer of polyethylene, an intermediate layer of a barrier material, and an outer layer of a polyolefin, wherein said inner layer of polyethylene is bonded to said head.

* * * * *